US005607254A

United States Patent [19]

Grembowicz et al.

[11] Patent Number: 5,607,254

[45] Date of Patent: Mar. 4, 1997

[54] METHOD AND APPARATUS FOR AUTOMATICALLY CONTROLLING THE TEMPERATURE OF AN ASPHALT PAVER SCREED

[75] Inventors: Conrad G. Grembowicz, Peoria; Lee E. Huffman, Princeville; Wade D. Samson, Sycamore, all of Ill.

[73] Assignee: Caterpillar Inc., Peoria, Ill.

[21] Appl. No.: 445,126

[22] Filed: May 19, 1995

[51] Int. Cl.[6] ..... E01C 23/14

[52] U.S. Cl. ..... 404/79; 404/95; 404/118; 126/271.2 A

[58] Field of Search ..... 404/77, 79, 84.05, 404/95, 96, 108, 118; 432/159, 186; 110/186, 191; 126/271.24, 271.1

[56] References Cited

U.S. PATENT DOCUMENTS

| | | | |
|---|---|---|---|
| 4,561,800 | 12/1985 | Hatakenaka et al. | 404/79 |
| 4,926,797 | 5/1990 | Butler | 122/15 |
| 5,139,362 | 8/1992 | Richter et al. | 404/95 |
| 5,245,196 | 9/1993 | Cabalfin | 250/554 |
| 5,259,693 | 11/1993 | Raymond | 404/95 |
| 5,417,516 | 5/1995 | Birtchet . | |

OTHER PUBLICATIONS

Sales Brochure, T F Trading, Fredensborg, Denmark.

*Primary Examiner*—James A. Lisehora
*Attorney, Agent, or Firm*—David M. Masterson; Mario J. Donato

[57] ABSTRACT

In one aspect of the present invention, an automatic screed temperature control is disclosed. The control senses the screed temperature and compares the screed temperature to a lower set point. In response to the screed temperature being less than the lower set point, the control causes fuel to dispense into the combustion chamber and subsequently causes the fuel to ignite in order to heat the screed. The screed is heated until the screed temperature becomes greater than an upper set point.

7 Claims, 5 Drawing Sheets

METHOD AND APPARATUS FOR AUTOMATICALLY CONTROLLING THE TEMPERATURE OF AN ASPHALT PAVER SCREED

TECHNICAL FIELD

This invention relates generally to the field of asphalt paver control and, more particularly, to an automatic temperature control for an asphalt paver screed.

BACKGROUND ART

Asphalt pavers include a hopper for receiving paving material and a conveyor system for transferring the paving material from the hopper for discharge on the roadbed. Screw augers spread the material on the roadbed in front of a floating screed, which is connected to the paving machine by pivoting tow or draft arms. The screed functions to format and compact the paving material distributed by the augers, ideally leaving the finished road with a uniform, smooth surface.

It is important that the temperature of the screed is accurately controlled to an optimum temperature for "working" the paving material. If the screed temperature is controlled too low, then the paving material may adhere to the screed or be hard to work. But, if the screed temperature is controlled too high, the screed may warp or the paving material may be damaged. It is thus desirable to accurately control the screed temperature in an automatic fashion so that overheating or underheating does not occur.

The present invention is directed to overcoming one or more of the problems as set forth above.

DISCLOSURE OF THE INVENTION

In one aspect of the present invention, an automatic screed temperature control is disclosed. The control senses the screed temperature and compares the screed temperature to a lower set point. In response to the screed temperature being less than the lower set point, the control causes fuel to dispense into the combustion chamber and subsequently causes the fuel to ignite in order to heat the screed. The screed is heated until the screed temperature becomes greater than an upper set point.

BRIEF DESCRIPTION OF THE DRAWING

For a better understanding of the present invention, reference may be made to the accompanying drawings in which.

BEST MODE FOR CARRYING OUT THE INVENTION

Figure 1:
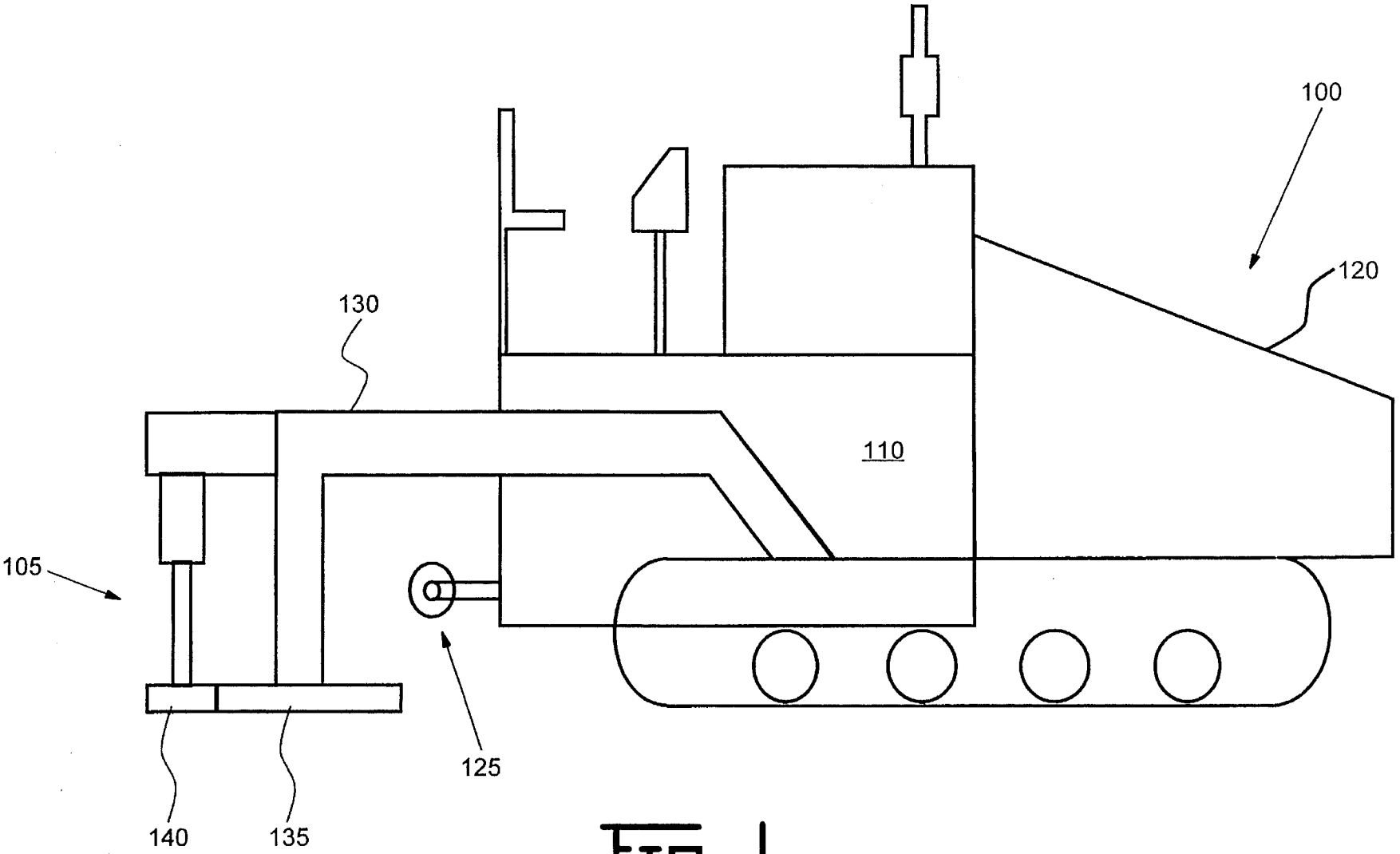
FIG. 1 illustrates a side view of an asphalt paver.

Referring now to the drawings, FIG. 1 illustrates a paver 100. The paver 100 may be of the rubber tire or crawler track type and includes a floating screed assembly 105. The paver 100 has a chassis 110 through which dual feed conveyors carry paving material, such as asphalt material, from a feed hopper 120 located at the front of the paver 100. Spreader augers 125, also referred to as spreading screws, are disposed transversely to and at the rear of the chassis 110. The augers 125 distribute the asphalt material transversely to the direction of travel of the paver 100. The material is spread over the desired width of a strip of pavement. The thickness and width of the pavement is established by the material-compacting, screed assembly 105. As shown, the screed assembly 105 is attached to the chassis 110 by a pair of draft arms 130. Preferably, the screed assembly 105 includes a main screed 135 and an extendable or extension screed 140. The main screed 135 is formed in two sections, one on each side of the center line of the paver. The extension screed 140 is mounted to each of the main screed sections.

Figure 2:
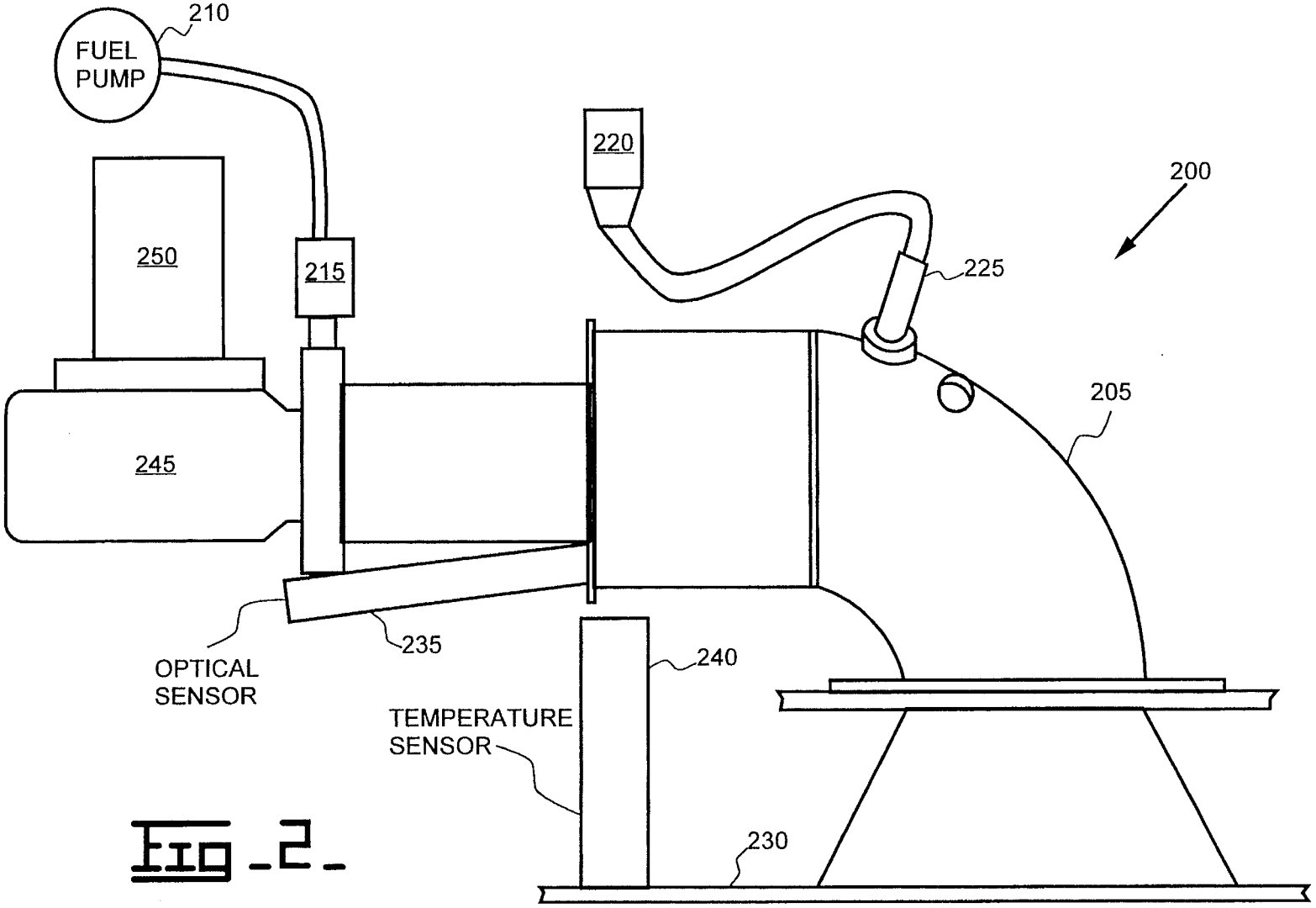
FIG. 2 illustrates a side view of a burner assembly.

The present invention is directed toward automatically controlling the temperature of each screed segment. Reference is now made to FIG. 2, which illustrates a burner assembly 200 (hereinafter referred to as a burner). The burner 200 includes a combustion chamber 205 that is used to contain a gaseous mixture of fuel and air. A temperature sensor 240 monitors the temperature of the screed segment 230. An electrically controlled fuel pump 210 supplies fuel to a solenoid actuated fuel valve 215 in response to the screed segment temperature being less than a lower desired temperature. For example, the fuel may be in the form of a liquid or gas, such as: diesel fuel or propane. Note, if propane is to be used, then a pump is not required.

Upon being energized, the fuel valve 215 dispenses fuel into the combustion chamber 205. An ignition coil 220 energizes a sparkplug 225 to ignite the gaseous mixture. A variable speed blower 245 forces air across the combustion chamber to further the ignition. The resulting combustion heats the screed segment 230. Although an ignition coil/spark plug assembly is discussed, those skilled in the art will recognize that a glow plug may instead be utilized.

An optical sensor 235 detects when ignition first occurs. The coil 220 is then de-energized and the blower 245 forces air at a high speed to further the combustion. Once the screed temperature reaches an upper desired temperature, the fuel pump 210 and fuel valve 215 are de-energized. The blower 245, however, continues to run in order to circulate the air and purge gases/smoke from the combustion chamber 205.

Figure 3:
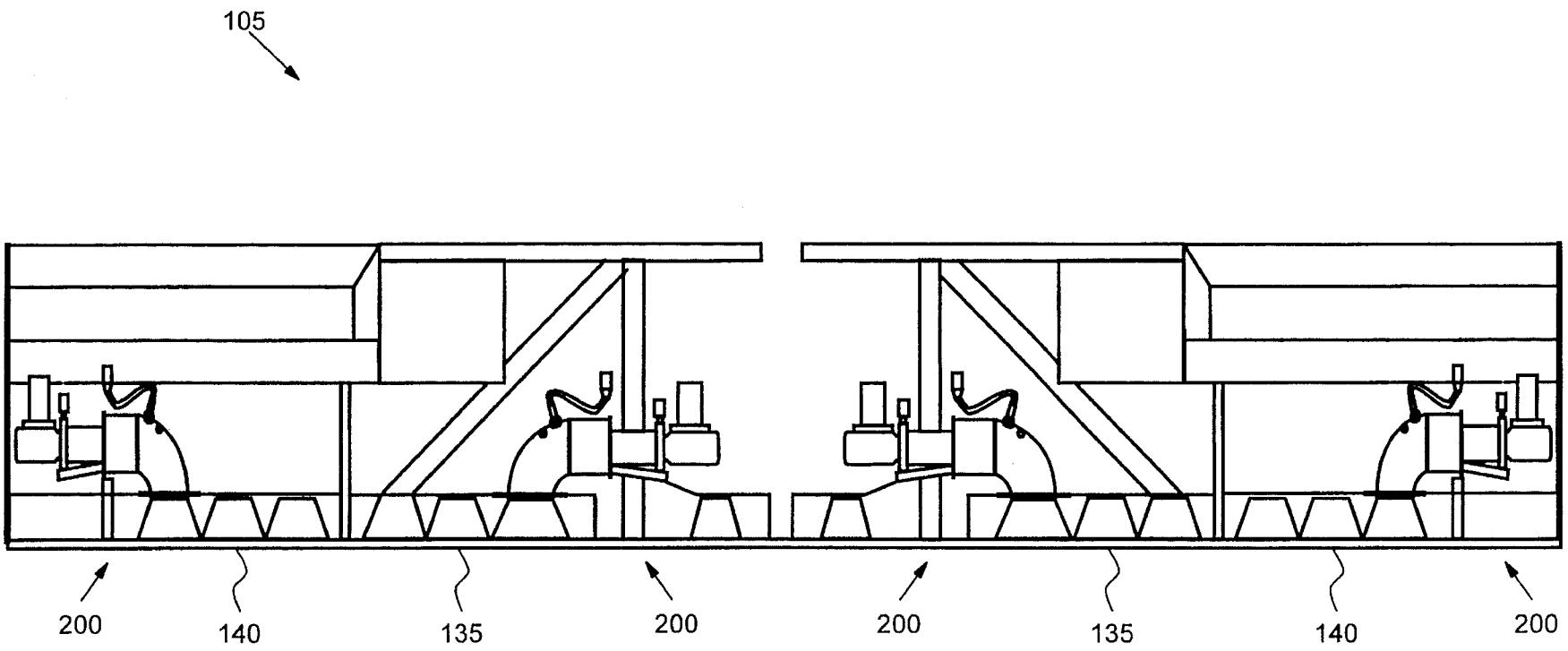
FIG. 3 illustrates a rear view of a screed assembly.

The rear view of the screed assembly 105 is illustrated with reference to FIG. 3. As shown, the screed assembly is comprised of left and right sections, each of which include two screed segments, e.g., a main screed segment and an extension screed segment. Each screed segment includes a burner 200 that is used to heat the associated screed segment.

Figure 4:
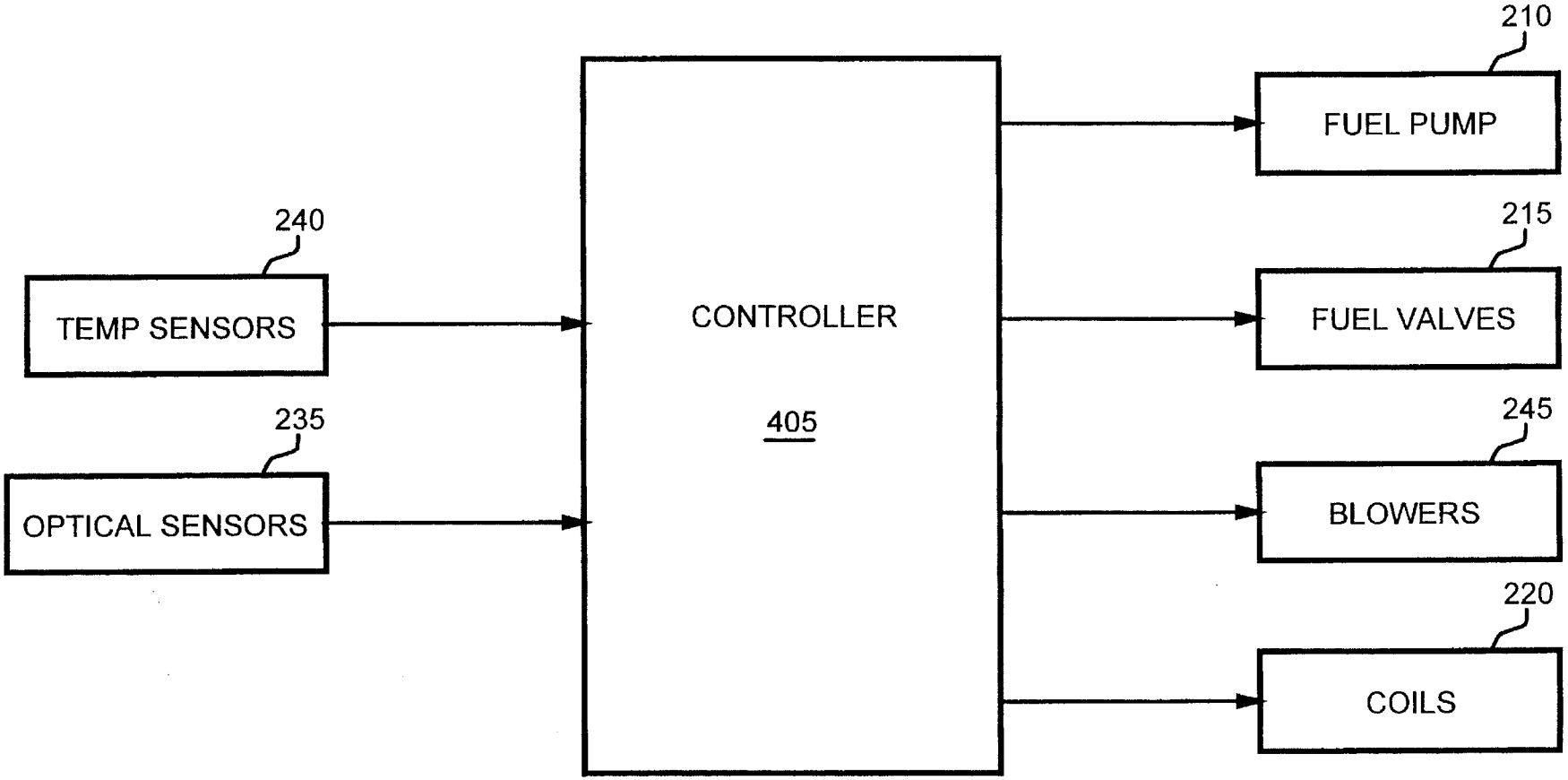
FIG. 4 illustrates a block diagram of a microprocessor based electrical control system that controls the operation of the burner.

Advantageously, the present invention controls the operation of each burner automatically. A block diagram of the electrical control system is illustrated in FIG. 4. A temperature sensor 240 produces a signal having a magnitude indicative of the temperature of a corresponding screed segment 230. Preferably, the temperature sensor 240 includes a thermocouple. An optical sensor 235 produces a signal that is indicative the gaseous mixture igniting. Preferably, the optical sensor 235 includes a photocell. Note that, the temperature and optical sensors may equally include an "RTD", thermo switch, thermocouple, photocell, or the like.

A microprocessor based controller 405 receives the temperature signal and compares the magnitude of the temperature signal to a lower set point. The controller 405 energizes the fuel pump 210 and valve 215 to dispense fuel in the corresponding combustion chamber in response to the temperature signal magnitude being less than the lower set point. Additionally, the controller 405 energizes the coil 220 to cause the spark plug 225 to ignite the fuel. The controller 405 operates the blower 245 at a low speed setting to further the ignition.

Once the optical sensor 235 detects ignition, the resulting ignition signal is delivered to the controller 405, operates the blower 245 at a high speed setting to increase the intensity of the combustion. Thereafter, the controller 405 compares the magnitude of the temperature signal to an upper set point. Once the temperature signal magnitude becomes greater than the upper set point, the controller 405 de-energizes the fuel pump 210, fuel valve 215, and coil 220.

Figure 5:
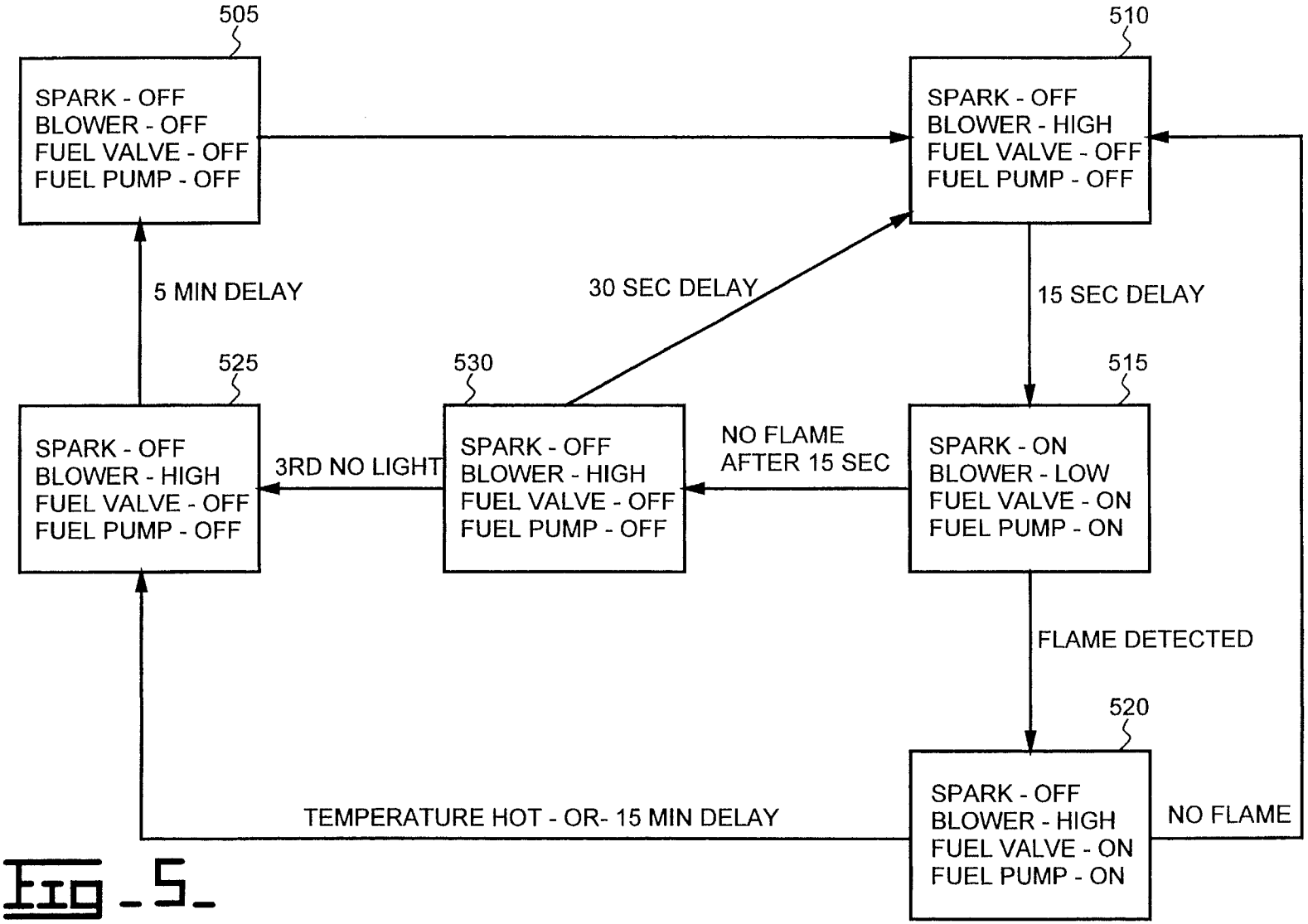
FIG. 5 illustrates a state diagram of the program control that is associated with the electrical control system.

Referring now to FIG. 5, a state diagram of the program control that is embedded in the firmware of the controller 405 is shown. Note that, although the state diagram is described as controlling a single burner, the same logic is applicable to all burners. Further, it is to be recognized that the program control may be used to automatically control the operation of the burners individually, sequentially, or simultaneously.

Initially, at block 505, all system components are turned off. Once the temperature of the screed falls below the lower set point, e.g., 250° F., the control proceeds to block 510. At block 510, any fumes that are contained in the combustion chamber are "purged" by forcing air at a high speed across the chamber for a predetermined time period, e.g., 15 seconds. The effect of purging the combustion chamber minimizes excessive combustion during initial ignition, which can be problematic with some fuels.

After the duration of the predetermined time period, control proceeds to block 515 where the fuel valve is energized to dispense fuel in the combustion chamber and the spark plug is energized to ignite the dispensed fuel. The spark plug is continuously energized until ignition is detected by the optical sensor. During ignition, the blower is operated at a low speed setting to mix the air and fuel in order to enhance ignition. Further, the low blower speed also provide a positive air pressure which directs the combustion flame and smoke toward the screed segment and away from other system components, i.e., the optical sensor.

Once ignition is detected, the control proceeds to block 520, where the blower is operated at a high speed setting so that air is forced into the combustion chamber in order to increase the intensity of the combustion, which in turn, increases the temperature of the screed.

Once the screed temperature rises above the upper set point, e.g., 350° F., or a predetermined delay period has elapsed, e.g., 15 minutes, control transfers to block 525. However, if the resulting combustion flame has extinguished prior to the screed temperature reaching the upper set point or prior to the predetermined delay period elapsing, then the control returns to block 510 to "relight" the burner.

At block 525, the blower is set to a high speed setting in order to clear the combustion chamber of the smoke and gasses that resulted from the combustion. The blower will remain on "high" for a predetermined time period, e.g., 5 minutes, at such time the control returns to block 505.

Referring back to block 515, if a combustion flame did not occur within a predetermined time period, e.g. 15 seconds, then the control transfers to block 530. At block 530, the blower is reset to "high" in order to clear the combustion chamber of any fumes. After a predetermined time period, e.g., 15 seconds, the control returns to block 510 to attempt another "lighting" sequence. However, after a predetermined number of failed ignitions (a predetermined number of times sequencing through blocks 510, 515 and 530), control transfers to block 525 for an indefinite time period. Note that, a warning light may be illuminated in response to a burner lighting problem or other electrical/combustion problems in order to warn the operator of a possible burner malfunction.

Thus, while the present invention has been particularly shown and described with reference to the preferred embodiment above, it will be understood by those skilled in the art that various additional embodiments may be contemplated without departing from the spirit and scope of the present invention.

We claim:

1. An apparatus for automatically controlling the temperature of a screed associated with an asphalt paving machine, the apparatus comprising:

a burner assembly having a combustion chamber;

a temperature sensor that senses the screed temperature and produces a signal having a magnitude indicative of the screed temperature;

means for dispensing fuel in the combustion chamber;

means for igniting the fuel in the combustion chamber;

control means for receiving the temperature signal, comparing the magnitude of the temperature signal to a lower set point, and initiating the means for dispensing fuel and the means for igniting to ignite the fuel in order to increase the screed temperature in response to the screed temperature being less than the lower set point;

a variable speed blower for forcing air across the combustion chamber; and means for sensing when ignition occurs and responsively producing a signal indicative of the ignition;

wherein said control means compares the temperature signal to an upper set point, causes the means for dispersing fuel to stop dispensing fuel and the means for igniting to stop igniting the fuel in response to the screed temperature being greater than the upper set point, and causes operation of the blower to continue for a predetermined period of time after combustion ceases to purge gases from the combustion chamber.

2. An apparatus, as set forth in claim 1, wherein the control means receives the ignition signal and controls the operation of the blower from a low speed to a high speed in order to increase the intensity of the combustion.

3. An apparatus, as set forth in claim 2, wherein the temperature sensor includes a thermocouple.

4. An apparatus, as set forth in claim 3, wherein the ignition sensing means includes a photocell.

5. An apparatus, as set forth in claim 4, wherein the for dispensing fuel means includes an electrically controlled fuel pump that delivers fuel to a solenoid actuated fuel valve.

6. An apparatus, as set forth in claim 5, wherein the means for igniting includes a high voltage coil that energizes a spark plug.

7. A method for automatically controlling the temperature of a screed associated with an asphalt paving machine, the asphalt paving machine including a burner assembly having a combustion chamber, the method comprising the steps of:

sensing the screed temperature and producing a signal having a magnitude indicative of the screed temperature;

receiving the temperature signal and comparing the temperature signal magnitude to a lower set point;

causing fuel to dispense and subsequently ignite in the combustion chamber in response to the temperature signal magnitude being less than the lower set point;

sensing when ignition occurs and producing a signal indicative of the ignition;

receiving the ignition signal and forcing air across the combustion chamber to increase the intensity of combustion;

comparing the temperature signal magnitude to an upper set point;

stopping the combustion in response to the temperature signal magnitude being greater than the upper set point; and continuing forcing air across the combustion chamber for a predetermined period of time after combustion ceases to purge gases from the combustion chamber.

* * * * *

UNITED STATES PATENT AND TRADEMARK OFFICE

CERTIFICATE OF CORRECTION

PATENT NO. : 5,607,254

DATED : March 4, 1997

INVENTOR(S) : Grembowicz et. al.

It is certified that error appears in the above-indentified patent and that said Letters Patent is hereby corrected as shown below:

Claim 5, should read as following-- An apparatus, as set forth in claim 4, wherein the means for dispensing fuel includes an electrically controlled fuel pump that delivers fuel to a solenoid actuated fuel valve.

Signed and Sealed this

Twenty-ninth Day of July, 1997

Bruce Lehman

*Attest:*

BRUCE LEHMAN

*Attesting Officer*

*Commissioner of Patents and Trademarks*